US007381059B2

(12) United States Patent
Wong

(10) Patent No.: US 7,381,059 B2
(45) Date of Patent: Jun. 3, 2008

(54) POWER SUPPLY DEVICE WITH ROTATABLE PLUG

(75) Inventor: Shih-Chi Wong, Tu Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 205 days.

(21) Appl. No.: 11/308,588

(22) Filed: Apr. 10, 2006

(65) Prior Publication Data

US 2007/0091545 A1 Apr. 26, 2007

(30) Foreign Application Priority Data

Oct. 21, 2005 (TW) ..... 94137008

(51) Int. Cl.
*H01R 39/00* (2006.01)

(52) U.S. Cl. ..... 439/22; 439/172; 439/27; 439/131

(58) Field of Classification Search ..... 439/22, 439/27, 131, 172, 173, 518
See application file for complete search history.

(56) References Cited

U.S. PATENT DOCUMENTS

| | | | | |
|---|---|---|---|---|
| 6,039,608 | A * | 3/2000 | Amero et al. | 439/651 |
| 6,087,594 | A | 7/2000 | Chou | |
| 6,089,921 | A * | 7/2000 | Chou | 439/640 |
| 6,592,386 | B2 * | 7/2003 | Teng et al. | 439/172 |
| 6,669,495 | B2 * | 12/2003 | Philips et al. | 439/170 |
| 6,821,134 | B2 * | 11/2004 | Chen | 439/131 |
| 6,923,667 | B1 * | 8/2005 | Chen | 439/172 |

* cited by examiner

*Primary Examiner*—Tho D. Ta
(74) *Attorney, Agent, or Firm*—Wei Te Chung

(57) ABSTRACT

A power supply device (10) includes a base (20) and a plug (30). The base includes a top wall (22), a recessed portion (24) defined in the top wall, and a locating portion (280) formed in the recessed portion. The plug is rotatably received in the recessed portion, and includes a protruding portion (322) received in the locating portion. When the protruding portion moves along the locating portion, the plug rotates relative to the base.

17 Claims, 6 Drawing Sheets

POWER SUPPLY DEVICE WITH ROTATABLE PLUG

FIELD OF THE INVENTION

The present invention pertains to power supply devices, and particularly to a power supply device with a rotatable plug.

DESCRIPTION OF RELATED ART

Electronic apparatuses, such as access points, mobile phones, notebooks, and so on, are becoming ever more popular. Each of the electronic apparatuses needs a power supply device to supply power thereto, and thus the power supply device is a necessary unit.

Referring to FIG. 6, an isometric view of a conventional power supply device 50 is shown. The power supply device 50 comprises a case 52 and a plug 54 coupled to the case 52. The plug 54 comprises a pair of lead terminals 540, a pair of first contact portions 544, and a pair of cams 542 protruding from opposite sides of a back portion thereof. The lead terminals 540 can be inserted into sockets of a receptacle (not shown). The plug 54 pivots with respect to the case 52 via the cams 542. The case 52 comprises a pair of second contact portions 520 electrically connected to the first contact portions 544, and a receiving space 624 for receiving the plug 54.

The plug 54, however, may be easily displaced or disengaged from the case 62 when using the power supply device 50. When the plug 54 is forcibly detached from the receiving space 524 of the case 52 during use, lead terminals 540 of the plug 54 may still remain in the receptacle. When this happens, the first contact portions 544 of the plug 54 may shock a user when the user disengages the plug 54 from the receptacle and accidentally touches the first contact portions 544. In addition, since the plug 54 is in a fixed orientation with respect to the receptacle once the power supply device 50 is plugged into the receptacle, there is no remedy if the power supply device 50 blocks other nearby sockets.

Therefore, a heretofore unaddressed need exists in the industry to overcome the aforementioned deficiencies and inadequacies.

SUMMARY OF INVENTION

In an exemplary embodiment, a power supply device includes a base and a plug. The base includes a top wall, a recessed portion defined in the top wall, and a locating portion formed in the recessed portion. The plug is rotatably received in the recessed portion, and includes a protruding portion received in the locating portion. When the protruding portion moves along the locating portion, the plug rotates relative to the base.

Other advantages and novel features will become more apparent from the following detailed description of preferred embodiments when taken in conjunction with the accompanying drawings, in which:

DETAILED DESCRIPTION

Figure 1:
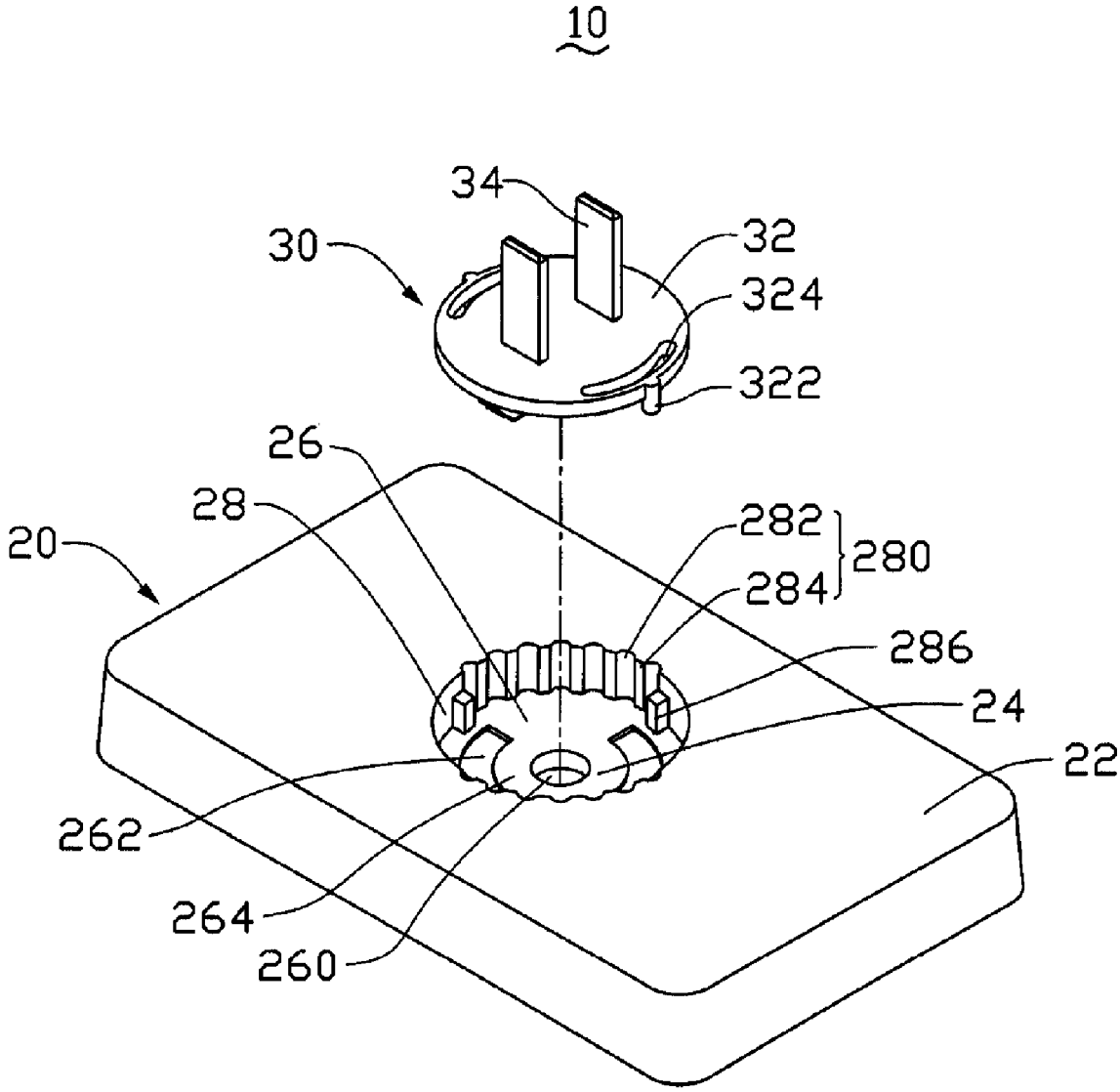
FIG. 1 is an exploded, isometric view of a power supply device of an exemplary embodiment of the present invention, the power supply device includes a base and a plug.

Referring to FIG. 1, a power supply device 10 of an exemplary embodiment of the present invention comprises a base 20 and a plug 30.

Figure 3:
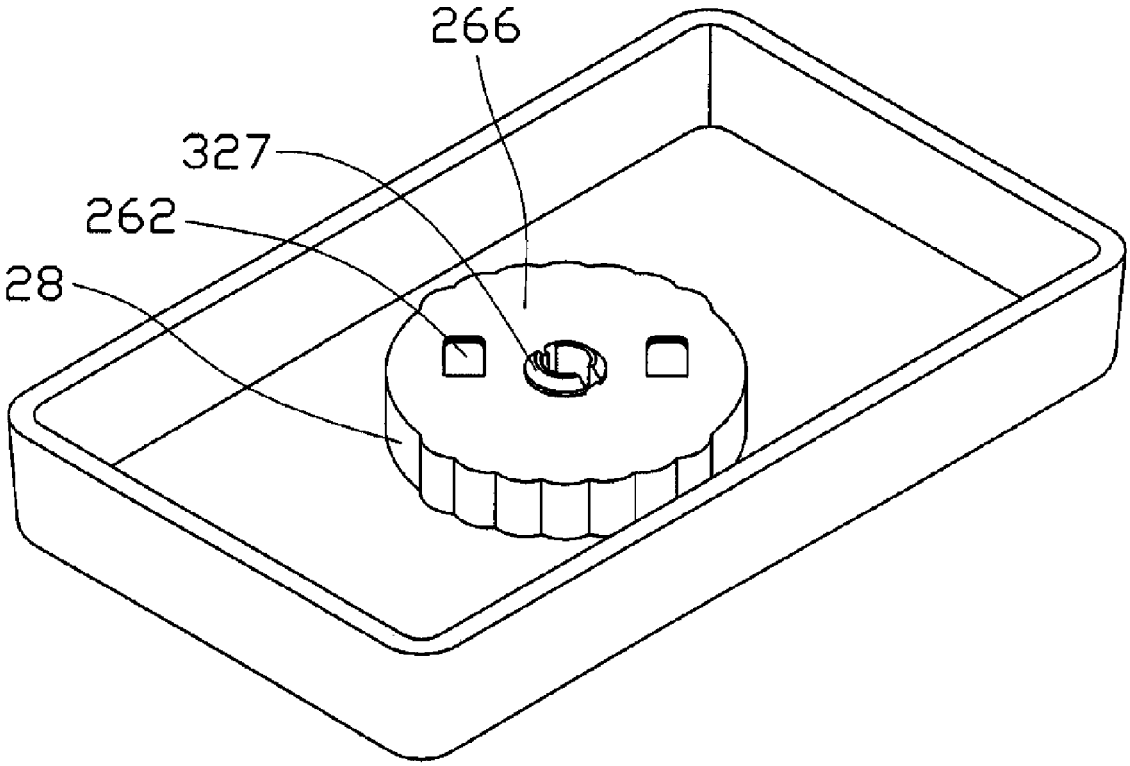
FIG. 3 is an inverted, assembled view of FIG. 1, but not showing a bottom wall of the base of FIG. 1.
Figure 4:
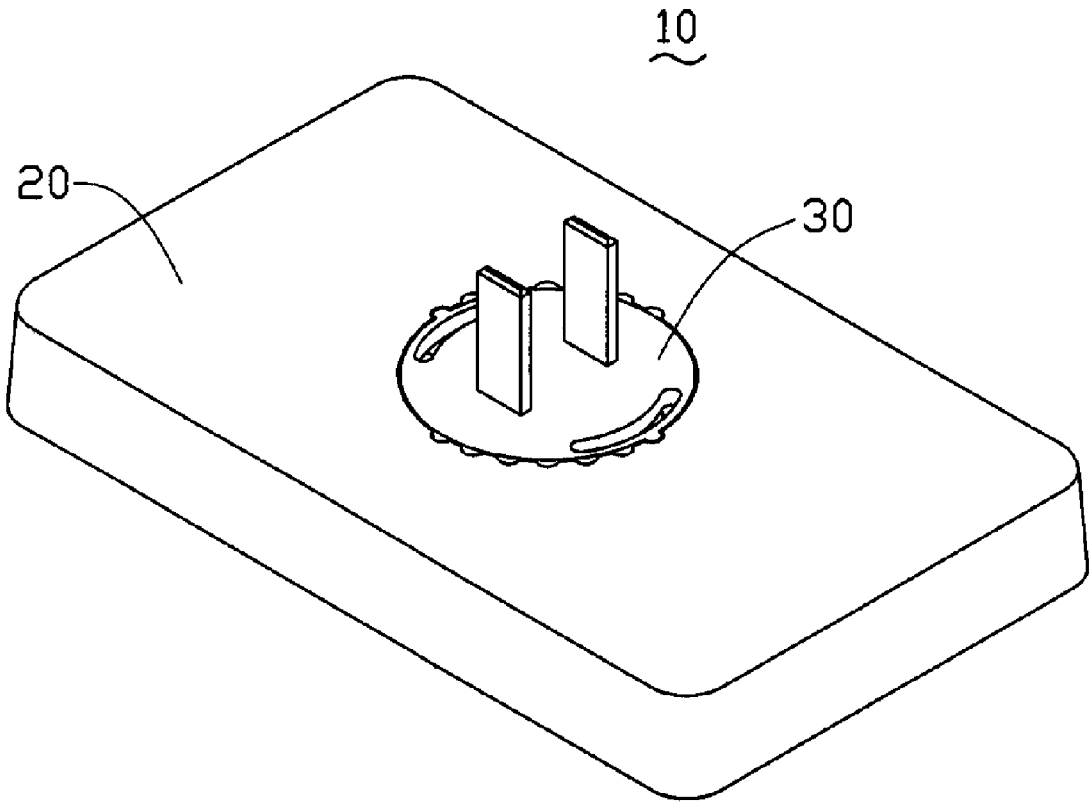
FIG. 4 is an assembled view of FIG. 1.

Referring also to FIG. 3, the base 20 comprises a top wall 22, and a circular recessed portion 24 formed by a sidewall 28 and a bottom wall 26 in a middle portion of the top wall 22. The bottom wall 26 comprises a first surface 264, a second surface 266 opposite to the first surface 264, and a through hole 260 defined in a middle thereof. The base 20 further comprises a pair of curved conducting contacts 262 formed on the first surface 264 and a portion of the contacts 262 pass through the first surface 264 to be exposed on the second surface 266. The conducting contacts 262 are symmetrical about a first axis of the bottom wall 26. An arc angle of each conducting contact 262 is equal to or greater than 90(. The base 20 further comprises a pair of locating portions 280 formed in the sidewall 28. The locating portions 280 are symmetrical about a second axis of the bottom wall 26 perpendicular to the first axis. Each of the locating portions 280 comprises a plurality of rib portions 284, and a plurality of locating slots 282 defined between every two adjacent rib portions 284 and at each end of the locating portions 280. The base 20 further comprises a pair of stopper portions 286 formed at opposite ends of one of the locating portions 280 respectively. A height of each of the stopper portions 286 is shorter than an overall height of the sidewall 28.

Figure 2:
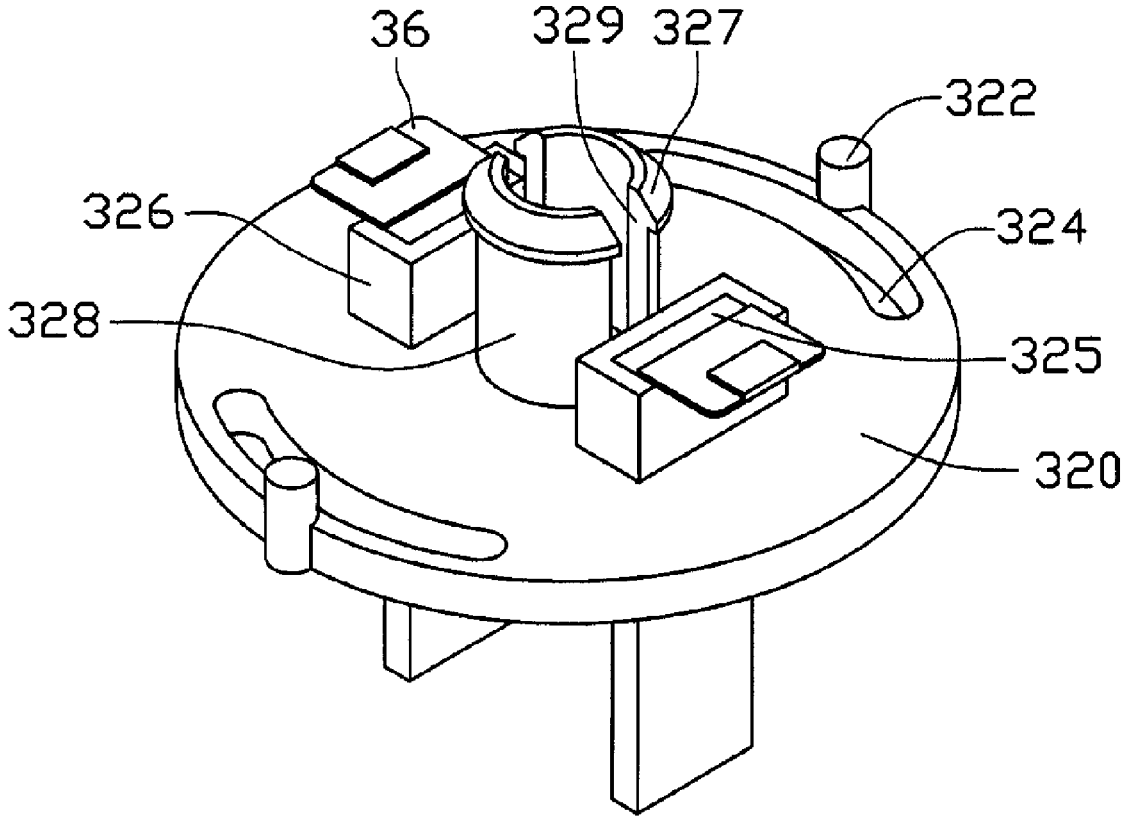
FIG. 2 is an enlarged, inverted, isometric view of the plug of the power supply device of FIG. 1.

Referring to FIGS. 1 and 2, the plug 30 comprises a circular main body 32 received in the recessed portion 24 of the base 20, a pair of terminals 34 disposed on the main body 32, and a pair of contact portions 36 electrically connected to the corresponding conducting contacts 262. The terminals 34 electrically connect to a receptacle having a plurality of sockets (not shown). The main body 32 comprises a hollow post 328 protruding from a center of a bottom surface 320 thereof, and a pair of receiving portions 326 symmetrical about the post 328. Each receiving portion 326 defines a receiving aperture 325. Each terminal 34 passes through the receiving aperture 325 and is coupled to each contact portion 36. The post 328 comprises an arch-shaped skirt 327 located at a periphery of a distal end thereof. A pair of opposite grooves 329 is defined in the post 328, thereby the skirt 327 is divided into two parts. Each groove 329 spans from a distal end of the post 328 to a portion of the post 328 adjacent to the bottom surface 320. The grooves 329 provide the post 328 with good resiliency, so that the post 328 can be deformably received through the hole 260. The main body 32 further comprises a pair of protruding portions 322 protruding from a periphery thereof, and a pair of curved slots 324 each adjacent to each protruding portion 322 to provide each protruding portion 322 with good resiliency. The protruding portions 322 are symmetrical about an axis of the main body 32 perpendicular to the post 328. Each protruding portion 322 projects beyond the bottom surface 320 of the main body 32. The protruding portions 322 and the stopper portions 286 of the base 20 cooperate to prevent the base 20 from being rotated excessively.

Referring to FIGS. 1-4, in assembly, the post 328 of the plug 30 is inserted into the hole 260 of the base 20, the post 328 is squeezed and deformably received through the hole 260 until the skirt 327 of the post 328 has passed through the hole 260. The post 328 resiliently rebounds, so that the skirt 327 abuts again the second surface 266 near the hole 260.

Simultaneously, each protruding portion 322 of the plug 30 is received in one of the locating slots 282 of each locating portion 280. Thereby, the plug 30 is rotatably mounted in the recessed portion 24 of the base 20. In disassembly, the skirt 327 of the post 328 is pushed radially inwardly until it is deformably received in the hole 260. Then the plug 30 can be disengaged from the recessed portion 24.

During use, the terminals 34 of the plug 30 are inserted into two of the matching sockets of the receptacle. If the base 20 of the power supply device 10 blocks other nearby sockets of the receptacle, the base 20 can be rotated right or left relative to the receptacle until the other nearby sockets of the receptacle that were shielded by the base 30 are revealed while the plug 30 remains in place in the receptacle.

Because the skirt 327 of the post 328 of the plug 30 abuts against the second surface 266 of the bottom wall 26 of the base 20, the plug 30 cannot be accidentally pulled out of the recessed portion 24 of the base 20 during use. In addition, the plug 30 can thereby be protected from damage.

Because the post 328 of the plug 30 has good resiliency, the post 328 can be easily passed through the hole 260 of the base 20. Thus the plug 30 can be assembled into or disassembled from the base 20 easily.

Figure 5:
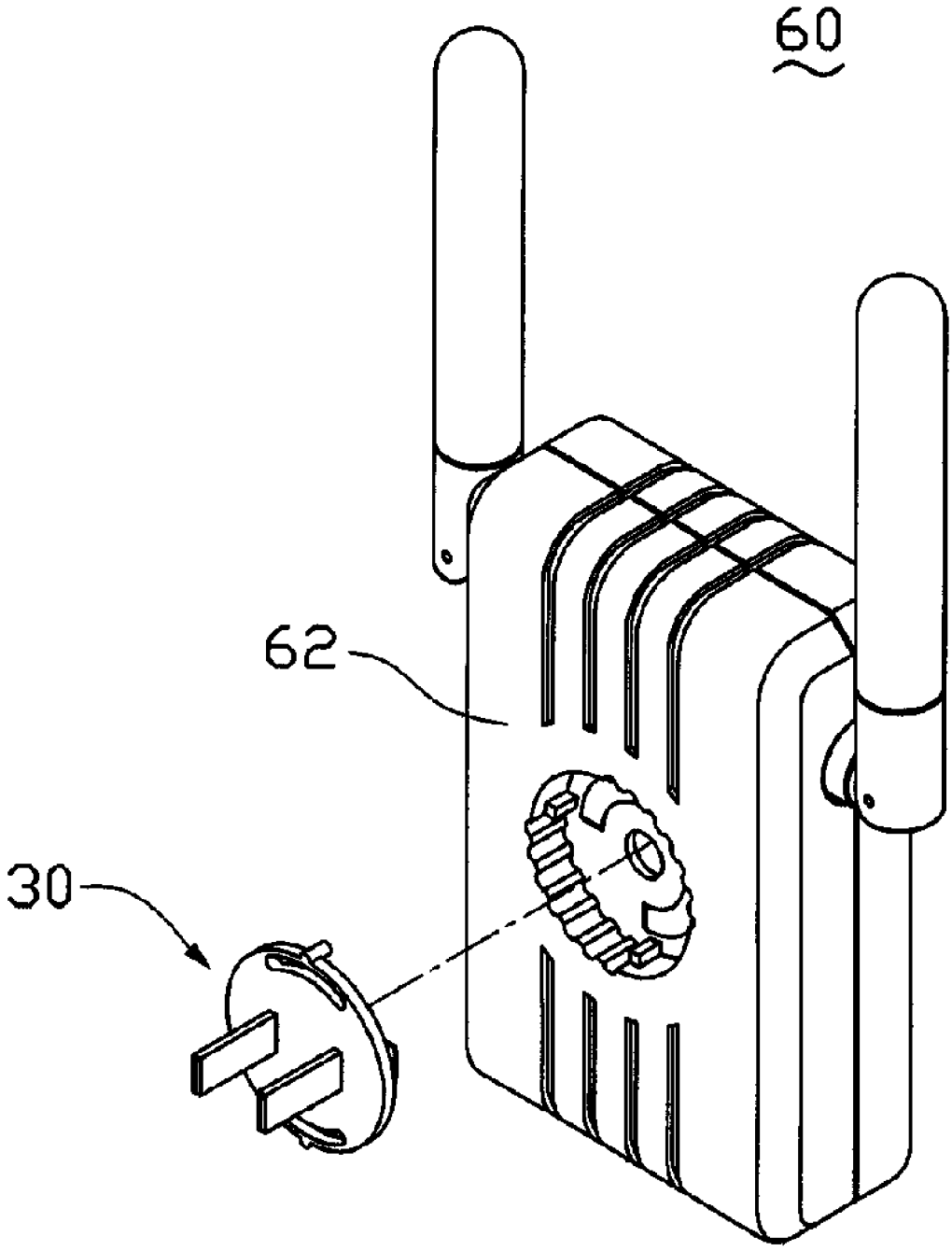
FIG. 5 is an exploded, isometric view of an electrical device having the same elements as the base and the plug of FIG. 1.
Figure 6:
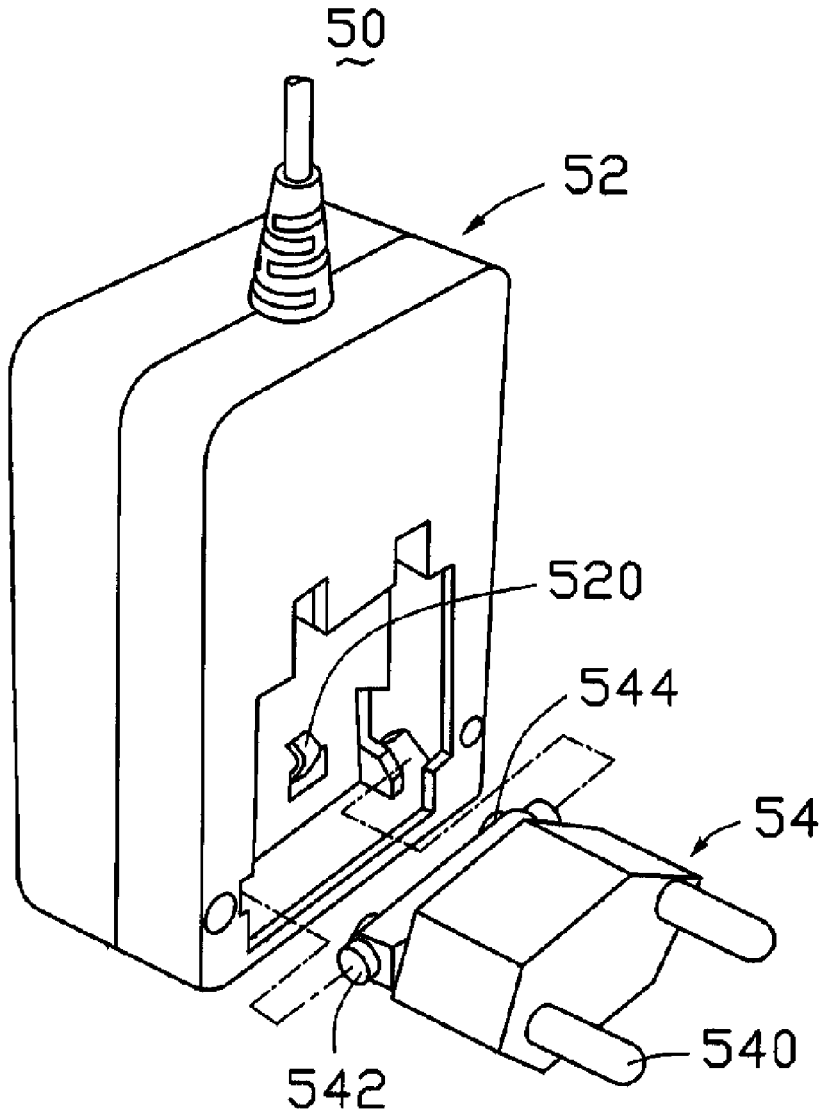
FIG. 6 (RELATED ART)
FIG. 6 is an exploded, isometric view of a conventional power supply device.

Referring to FIG. 5, in an alternative embodiment, the power supply device 10 may be a part of an electronic device 60, such as a WiFi Repeater. The electronic device 60 comprises a case 62 having same elements and performing the same function as the base 20. That is, the case 62 comprises the elements of the base 20, and the plug 30 can be mounted to the case 62 of the electronic device 60.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A power supply device, comprising:

a base comprising a top wall, a recessed portion defined in the top wall, and a locating portion formed in the recessed portion; and a plug rotatably received in the recessed portion, the plug comprising a protruding portion received in the locating portion;

wherein when the protruding portion moves along the locating portion, the plug rotates relative to the base;

wherein the plug comprises a bottom surface and a hollow post protruding from a middle of the bottom surface;

wherein the post comprises an arch-shaped skirt at a periphery of a distal end thereof, and a pair of opposite grooves defined therein to provide the post with resiliency.

2. The power supply device as claimed in claim 1, wherein the plug and the recessed portion respectively have a generally circular shape.

3. The power supply device as claimed in claim 1, wherein a hole is defined in the recessed portion for receiving the post.

4. The power supply device as claimed in claim 1, wherein the plug comprises a pair of receiving portions symmetrical about the post.

5. The power supply device as claimed in claim 1, wherein the base comprises a pair of conducting contacts in the recessed portion, and the plug comprises a pair of contact portions electrically connected to the conducting contacts.

6. The power supply device as claimed in claim 1, wherein the recessed portion comprises a sidewall and a bottom wall, the locating portion is two locating portions and symmetrically formed in the sidewall.

7. The power supply device as claimed in claim 6, wherein each of the locating portions comprises a plurality of rib portions, and a plurality of locating slots defined between every two adjacent rib portions and at each end of the locating portions, the protruding portion received in one of the locating slots.

8. The power supply device as claimed in claim 6, wherein the base further comprises a pair of stopper portions formed at opposite ends of one of the locating portions respectively.

9. The power supply device as claimed in claim 1, wherein the plug comprises a pair of protruding symmetrically protruding from a periphery of the main body.

10. The power supply device as claimed in claim 9, wherein the plug defines a pair of curved slots each adjacent a respective one of the protruding portions.

11. An electronic device, comprising:

a case comprising a top wall, a recessed portion defined in the top wall, and a locating portion formed in the recessed portion; and a plug rotatably received in the recessed portion, the plug comprising a protruding portion received in the locating portion;

wherein when the protruding portion moves along the locating portion, the plug rotates relative to the base;

wherein the plug comprises a bottom surface and a hollow post protruding from a middle of the bottom surface;

wherein the post comprises an arch-shaped skirt at a periphery of a distal end thereof, and a pair of opposite grooves defined therein to provide the post with resiliency.

12. The electronic device as claimed in claim 11, wherein the plug and the recessed portion respectively have a generally circular shape.

13. The electronic device as claimed in claim 11, wherein the locating portion comprises a plurality of rib portions, and a plurality of locating slots defined between every two adjacent rib portions and at each end of the locating portion, the protruding portion received in one of the locating slots.

14. The electronic device as claimed in claim 11, wherein a hole is defined in the recessed portion for receiving the post.

15. The electronic device as claimed in claim 11, wherein the plug comprises a pair of receiving portions symmetrical about the post.

16. The electronic device as claimed in claim 11, wherein the base further comprises a pair of stopper portions formed at opposite ends of the locating portion respectively.

17. A power supply device, comprising:

a base comprising a top wall, a recessed portion defined in the top wall, and a locating portion formed in the recessed portion; and a circular plug rotatably received in the recessed portion, the circular plug comprising a protruding portion received in the locating portion;

wherein when the protruding portion moves along the locating portion, the circular plug rotates relative to the base; and wherein the circular plug defines a curved slot in compliance with a circular contour of the circular plug and adjacent to the protruding portion for providing resiliency thereof.

* * * * *